US008167124B2

(12) United States Patent
Uesugi et al.

(10) Patent No.: US 8,167,124 B2
(45) Date of Patent: May 1, 2012

(54) SLIDE-ACTION HINGE-LID PACKAGE

(75) Inventors: Hiroyuki Uesugi, Tokyo (JP); Kazuhiro Yoshimura, Tokyo (JP); Hidehisa Tokita, Tokyo (JP); Masahiro Fukui, Tokyo (JP); Akihiro Saito, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/955,451

(22) Filed: Nov. 29, 2010

(65) Prior Publication Data

US 2011/0068027 A1 Mar. 24, 2011

Related U.S. Application Data

(63) Continuation of application No. PCT/JP2009/060021, filed on Jun. 2, 2009.

(30) Foreign Application Priority Data

Jun. 6, 2008 (JP) ..... 2008-149238

(51) Int. Cl.
*B65D 85/10* (2006.01)

(52) U.S. Cl. ..... 206/267; 206/270; 206/273; 229/129.1

(58) Field of Classification Search ..... 206/242, 206/265–268, 270, 271, 273; 229/125.37, 229/129.1
See application file for complete search history.

(56) References Cited

U.S. PATENT DOCUMENTS

| | | | | |
|---|---|---|---|---|
| 3,311,283 | A * | 3/1967 | Shimada et al. | 229/129.1 |
| 3,400,874 | A * | 9/1968 | Shimada et al. | 206/250 |
| 3,933,299 | A * | 1/1976 | Shimada et al. | 229/125.37 |
| 3,977,520 | A * | 8/1976 | Grimm | 206/270 |
| 4,049,117 | A * | 9/1977 | Grimm | 206/270 |
| 4,267,926 | A * | 5/1981 | Toimil | 206/268 |
| 4,646,960 | A * | 3/1987 | Challand | 206/259 |
| 5,634,556 | A | 6/1997 | Focke et al. | |
| 7,658,280 | B2 * | 2/2010 | Bardet et al. | 206/267 |
| 2007/0221517 | A1 | 9/2007 | Blome et al. | |

FOREIGN PATENT DOCUMENTS

| | | | |
|---|---|---|---|
| JP | 61-144024 | U | 9/1986 |
| JP | 3013076 | U | 6/1995 |
| JP | 8-68777 | A | 3/1996 |
| JP | 10-35644 | A | 2/1998 |
| JP | 2003-508313 | A | 3/2003 |
| JP | 2007-537937 | A | 12/2007 |
| WO | WO 01/15999 | A1 | 3/2001 |
| WO | WO 2005/115852 | A1 | 12/2005 |
| WO | WO 2007/122200 | A2 | 11/2007 |

* cited by examiner

*Primary Examiner* — Luan K Bui
(74) *Attorney, Agent, or Firm* — Birch, Stewart, Kolasch & Birch, LLP

(57) ABSTRACT

The package (2) has an inner case (7) having a box body (6) with an open end (22) in an upper portion and a lid (4) that is connected to a first side edge of the open end (22) and turns about a lid hinge (24) to open/close the open end (22); and an outer slider (8) that is slidably fitted in a periphery of the inner case (7), the outer slider (8) having a contact flap (48) extending towards the inside of the outer slider (8) in an upper edge (50) of a first side wall (44) corresponding to the lid hinge (24). The inner case (7) includes a band-like member (34), which is connected to the lid (4) at the upper end thereof and has a folded flap (38) engageable with the contact flap (48) of the outer slider (8) in a lower end thereof. When the outer slider (8) is slid down in relation to the inner case (7), the folded flap (38) is engaged with the contact flap (48) and opens the lid (4).

5 Claims, 9 Drawing Sheets

SLIDE-ACTION HINGE-LID PACKAGE

CROSS REFERENCE TO RELATED APPLICATIONS

This application is a Continuation of PCT International Application No. PCT/JP2009/060021 filed on Jun. 2, 2009, which claims the benefit of Patent Application No. 2008-149238 filed in Japan, on Jun. 6, 2008. The entire contents of all of the above applications is hereby incorporated by reference into the present application.

TECHNICAL FIELD

The invention relates to a slide-action hinge-lid package, and more specifically, to a slide-action hinge-lid package whose lid is opened in conjunction with a sliding action.

BACKGROUND ART

Various kinds of packaging containers for accommodating goods have been developed to fit characteristics of the goods. When the goods are, for example, filter cigarettes, cigarettes or the like, a hinge-lid package is often used as a packaging containers for them.

As one aspect of a hinge-lid package, for example, a hinge-lid package shown in Patent Document 1 has been suggested.

A conventional hinge-lid package includes a box-shaped outer body, which has an open end in its upper end. The outer body contains an inner pack inside. The inner pack includes a batch of paper-wrapped cigarettes and an inner wrapper that encloses the batch of cigarettes.

The open end of the outer body has a box-shaped lid in its rear edge through a hinge. The lid turns about the hinge to open/close the open end.

As the conventional hinge-lid package has been used for many years, the opening/closing pattern of its lid is familiar to consumers. On the other hand, it is not catchy enough to encourage people to buy the package.

To appeal to consumers, for example, a slide-action hinge-lid package shown in Patent Document 2 has been proposed as a package that is provided with a lid having a slide-action opening/closing pattern.

PRIOR ART DOCUMENT

Patent Document

Patent Document 1 Unexamined Japanese Patent Publication No. 8-58777

Patent Document 2 International Publication No. 2007/122200

ADVANTAGES OF THE INVENTION

Problem to be Solved by the Invention

The package disclosed in Patent Document 2 has a slider device, which surrounds a lower portion of a container of the package and is slidable in a longitudinal direction of the container. The slider device and the package lid are connected together with a lid flap. The lid is opened/closed through the lid flap by the sliding of the slider device. The container has a pair of stopper flaps. The slider device has engaging flaps used in combination with the respective stopper flaps. These stoppers and engaging flaps regulate the slide amount of the slider device in consort with each other. As described, the package disclosed in Patent Document 2 has a complicated configuration, so that production efficiency is low.

The present invention has been suggested to solve the foregoing problem. It is an object of the invention to provide a slide-action hinge-lid package that offers high production efficiency because of a simple configuration and has a novel opening/closing pattern that arouses consumers' interest.

Means for Solving the Problem

In order to achieve the above object, a slide-action hinge-lid package of the invention has an inner case being formed in a rectangular parallelepiped shape and having a box body with an open end in an upper portion and a box-shaped lid that is connected to a first side edge that is a short side of the open end and turns about a lid hinge to open/close the open end; an outer slider that is slidably fitted in a periphery of the inner case; and an engaging device that allows engagement between the inner case and the outer slider when the outer slider is slid in relation to the inner case, and applies an opening/closing action to the lid in conjunction with the sliding of the outer slider.

The lid is opened by sliding the outer slider downwards. The lid turns about the lid hinge provided to a first side portion that is a short side of the open end of the box body.

To be more specific, the engaging device includes a band-like member provided on an outer face of the lid, the band-like member extending along a side wall of the lid, which is located on the first-side-edge side, having an upper end connected to an upper part of the lid hinge through a top hinge parallel to the lid hinge, and having a lower end provided with a folded flap that is folded back towards an inner face of the outer slider; and a contact flap being provided to the inner face of the outer slider and extending towards the folded flap. When the outer slider is slid towards the folded flap, the contact flap is engaged with the folded flap.

When the outer slider is slid in a downward direction, the contact flap of the outer slider and the folded flap of the band-like member connected to the lid are engaged with each other. The first side portion of the lid is then relatively pulled downwards by the band-like member. This pulling action makes the lid turn about the lid hinge, thereby opening the lid.

Preferably, the top hinge is located in an upper edge of the side wall of the lid. The band-like member further has a middle hinge that is parallel to the top hinge and located between the top hinge and the folded flap. The middle hinge is located below the lid hinge when the band-like member is superimposed on the side wall of the lid. An upper edge of the outer slider is located under the middle hinge in order to expose the middle hinge from the outer slider at the same time or before the outer slider is slid to engage the contact flap with the folded flap.

With this configuration, the band-like member is bent at the middle hinge provided in the middle thereof, so that the lid can be smoothly opened.

Preferably, a projecting portion that is projecting further than the periphery of the inner case is formed on a peripheral edge of an upper wall of the lid.

With this configuration, since a part of the lid is projecting, the outer slider is regulated from sliding upwards by the upper end portion of the lid. It is possible, with the simple configuration, to prevent the outer slider from slipping out of the inner case.

In the slide-action hinge-lid package according to the invention, upper edges of front and rear walls of the box body, which are a pair of long sides of the open end, are inclined in an upward or downward direction from the lid hinge.

With this configuration, due to the diagonally-cut open end of the box body, contained goods are more widely exposed from the box body when the lid is opened. This makes it easier to retrieve the goods from the box body.

Advantages of the Invention

According to the slide-action hinge-lid package of the invention, with the relatively simple configuration including the band-like member provided to the lid and the contact flap provided to the outer slider, it is possible to open/close the lid and yet prevent the slipping out of the outer slider. Because of its simple configuration, the hinge-lid package of the invention contributes to enhancement of production efficiency. The lid of the invention turns about the hinge provided in the first side portion that is a short side of the open end of the box body, in conjunction with the sliding of the outer slider. The lid thus provides a unique opening/closing pattern as compared to ordinary package lids, strongly appealing to consumers. Consequently, the lid of the invention arouses consumers' interest.

BEST MODE OF CARRYING OUT THE INVENTION

Figure 1:
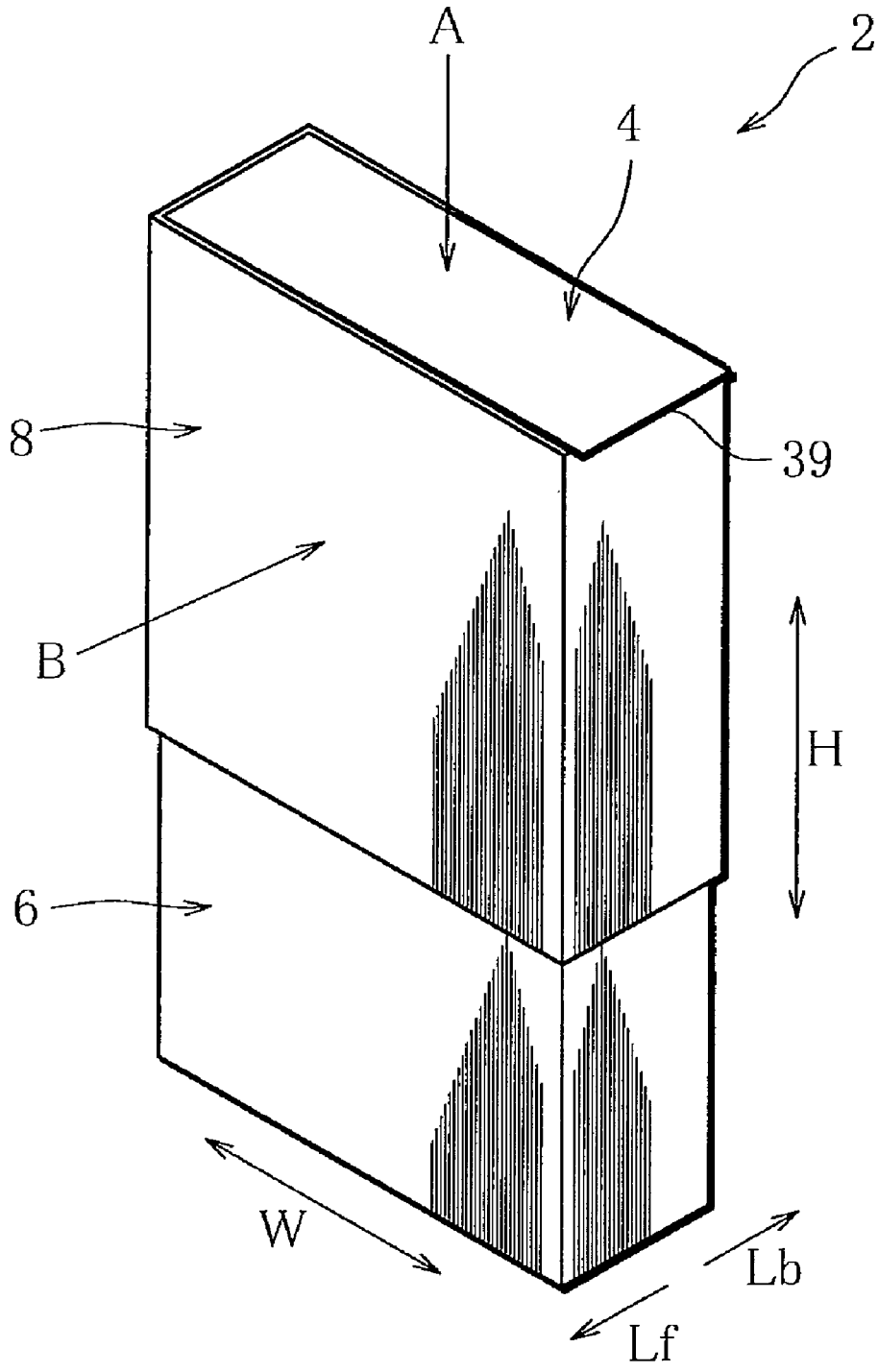
FIG. 1 is a perspective view showing a package of one embodiment in a closed position.

FIG. 1 shows a package 2 of one embodiment.

The package 2 is a packing container that contains tobacco products including filter cigarettes, cigarettes, etc. The package 2 has a rectangular parallelepiped shape as a whole.

In the present embodiment, to view from above means to see the package 2 in a direction of arrow A in FIG. 1, and to view from the front means to see the package 2 in a direction of arrow B in FIG. 1. An arrow H in FIG. 1 indicates a vertical direction of the package 2. An arrow W in FIG. 1 indicates a width direction of the package 2. An arrow Lf in FIG. 1 indicates an anterior direction of the package 2. An arrow Lb in FIG. 1 indicates a posterior direction of the package 2.

Figure 2:
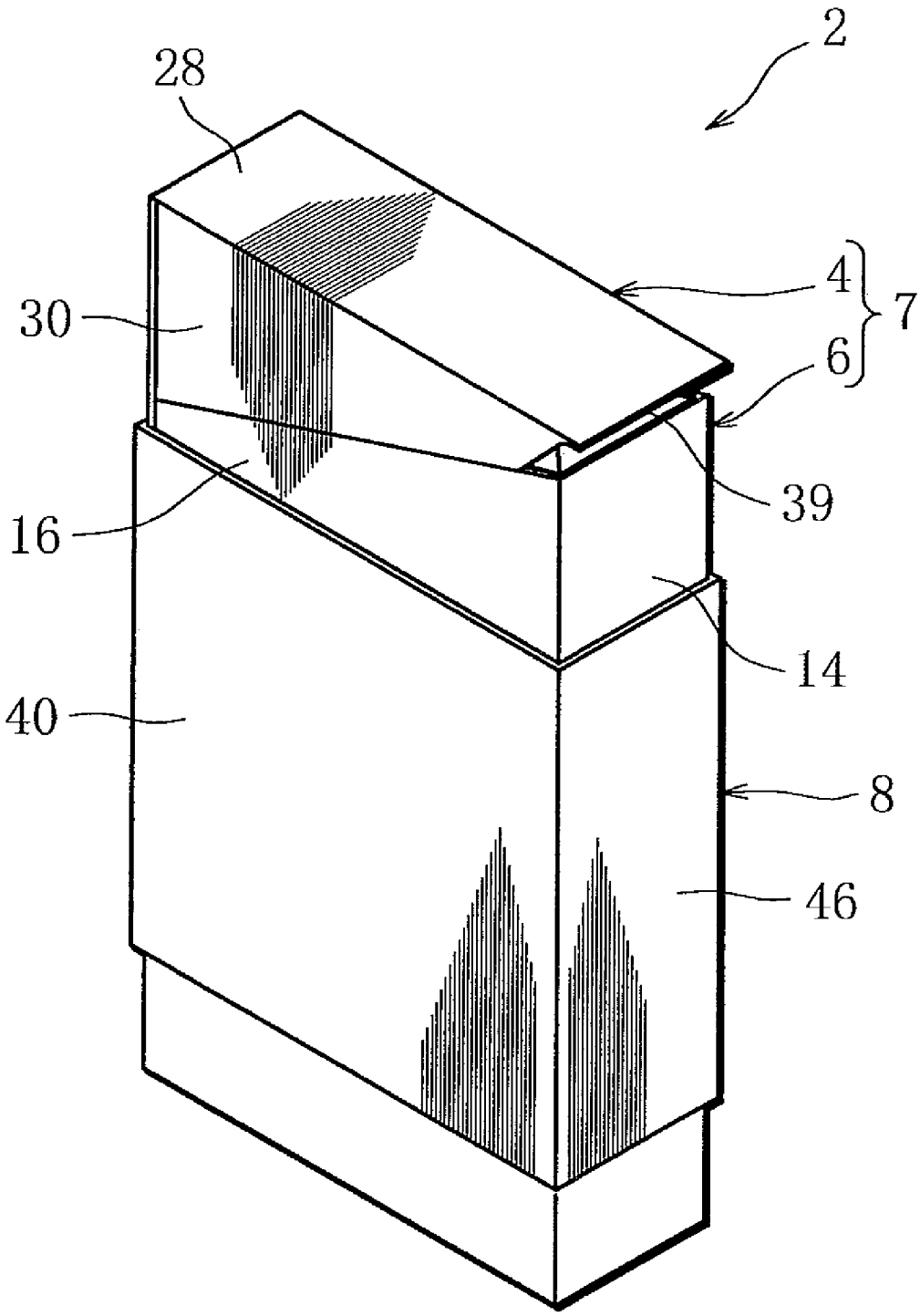
FIG. 2 is a perspective view of the package shown in FIG. 1, in which an outer slider is being pulled down.

As illustrated in FIG. 2, the package 2 includes a rectangular parallelepiped-shaped inner case 7 with a lid 4. The inner case 7 has an outer slider 8 that is slidably fitted to a periphery of the inner case 7.

Figure 3:
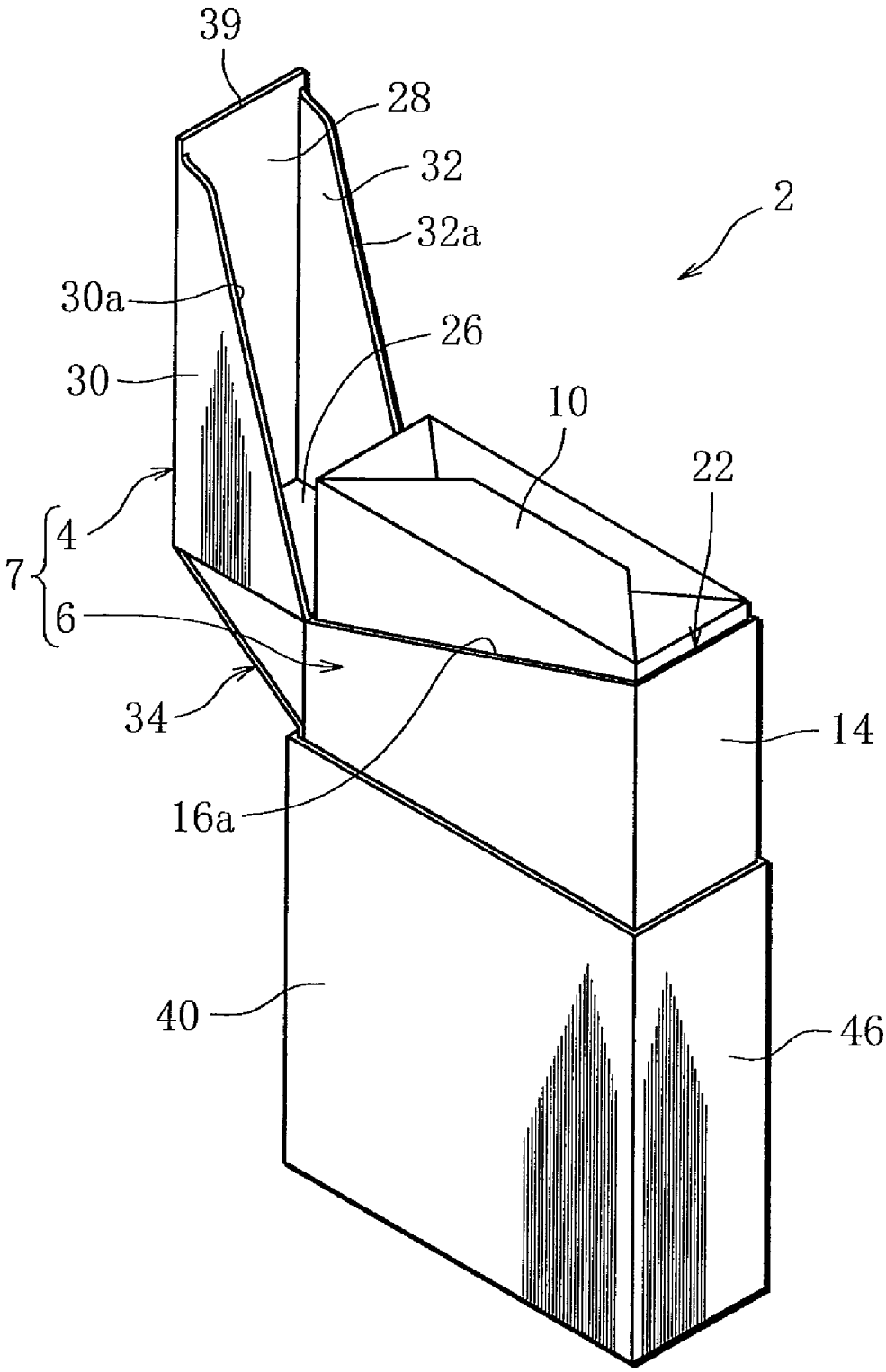
FIG. 3 is a perspective view of the package shown in FIG. 1 in an open position.

The inner case 7 includes a box body 6 that contains an inner pack 10 as illustrated in FIG. 3.

The box body 6 is a box with an upper end that is diagonally cut away. The inner pack 10 is formed by enclosing rod-like tobacco products 20 having a length of 95 mm in an inner wrapper. The inner wrapper includes paper and an aluminum film deposited on surfaces of the paper. The aluminum film of the inner wrapper not only protects the batch of tobacco products from moisture but also prevents aroma from escaping from the batch, namely, each of the tobacco products. Instead of the aluminum deposited paper, laminated paper may be used for the inner wrapper. The laminated paper is provided in the inside thereof with a shielding layer that blocks the transfer of moisture and aroma.

Figure 5:
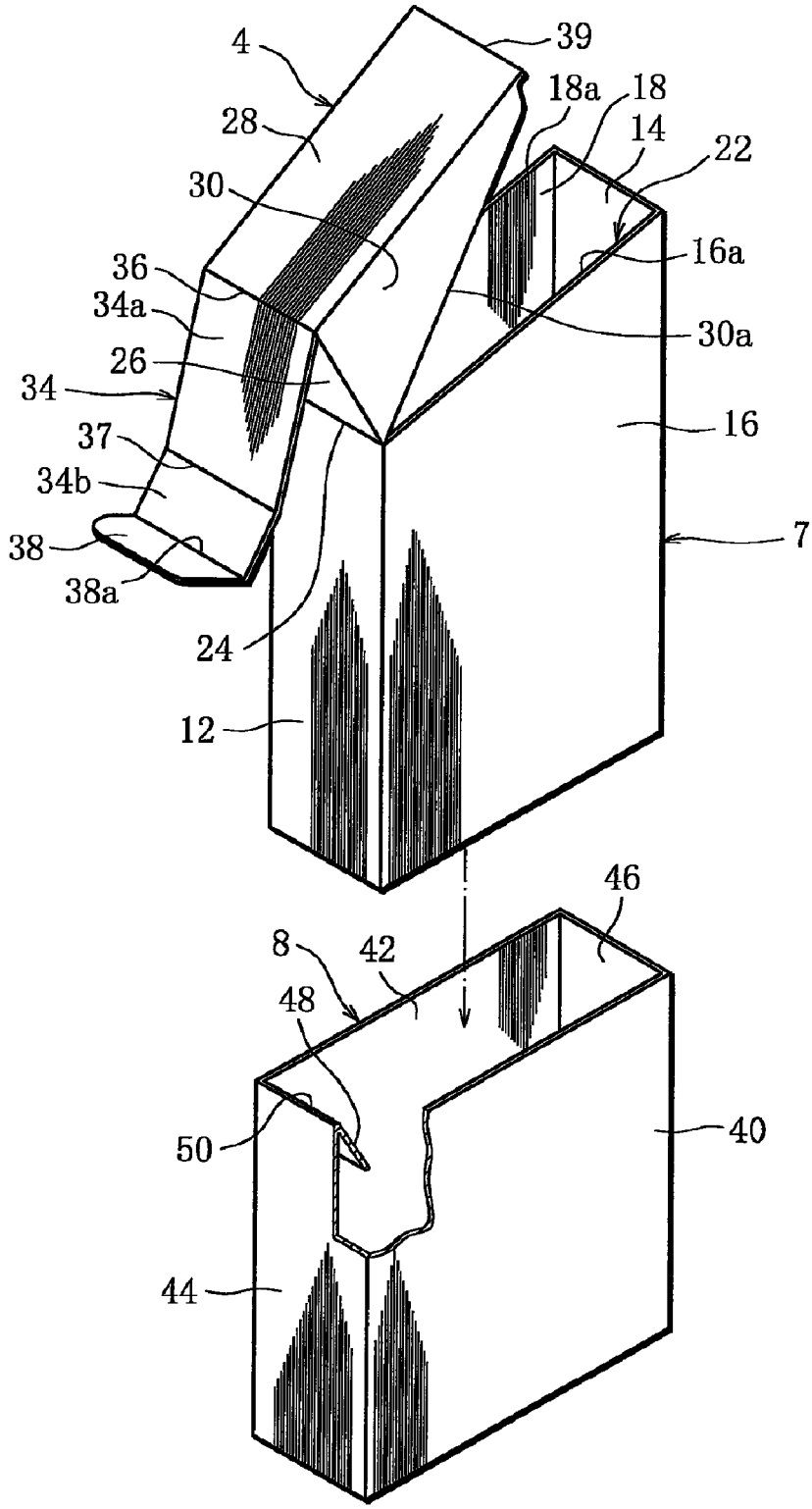
FIG. 5 is a perspective exploded view of the package shown in FIG. 1 partially broken away.

As illustrated in FIG. 5, the box body 6 has a first side wall 12, a second side wall 14 that is taller than the side wall 12, a front wall 16 and a rear wall 18 connecting the first side wall 12 and the side wall 14 together, and a bottom wall 20. An upper edge 16*a* of the front wall 16 and an upper edge 18*a* of the rear wall 18 are so inclined as to join an upper end of the first side wall 12 and an upper end of the second side wall 14 to each other. In short, the front wall 16 and the rear wall 18 each have an inclined upper edge. These upper edges extend parallel to each other. The box body 6 has an upper end formed in an open end 22 that is opened/closed with a lid 4. The open end 22 has a rectangular shape as viewed from above. Front and rear edges of the open end 2 are inclined as viewed from the front. Since the open end 22 is diagonally cut away not in side edges but in the front and rear edges as described, when the inner pack 10 is contained in the box body 6, an upper portion of the inner pack 10 is exposed in both the anterior and posterior directions Lf and Lb of the package 2.

An upper portion of the tobacco products is thus exposed in the anterior and posterior directions Lf and Lb of the package 2. In this manner, the box body 6 makes it easy to retrieve the tobacco products from the open end 22. In this respect, a conventional package has a box body with an open end having front and rear edges that are horizontal and have a different height. For that reason, an upper portion of an inner pack of the box body cannot be exposed both in anterior and posterior directions of the package.

A lid hinge 24 is formed in the upper end of the first side wall 12. The lid hinge 24 extends between the front wall 16 and the rear wall 18, connecting the side wall 12 and the lid 4 together.

Figure 4:
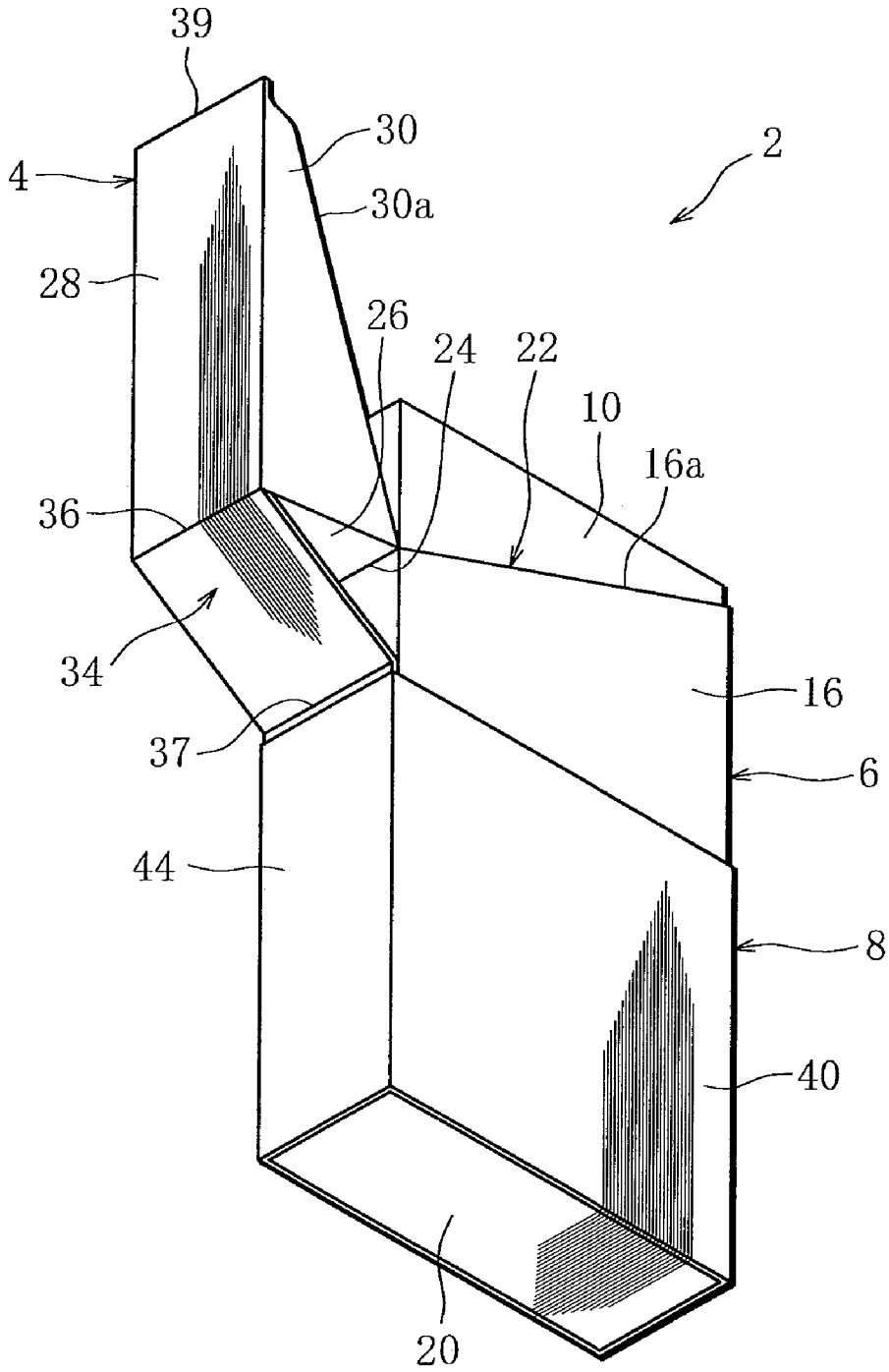
FIG. 4 is a perspective view of the package shown in FIG. 1 in the open position as viewed from beneath.

As illustrated in FIGS. 3 to 5, the lid 4 has a side wall 26 connected to the lid hinge 24, an upper wall 28, a front wall 30, and a rear wall 32. The front and rear walls 30 and 32 each have an approximate triangular shape. The lid 4 is turnable about the lid hinge 24. When the lid 4 is closed, inclined lower edges 30*a* and 32*a* of the front and rear walls 30 and 32 meet the upper edges 16*a* and 18*a*, respectively, of the open end 22.

A band-like member 34 is connected to the lid 4. More concretely, as is apparent from FIG. 5, the band-like member 34 has an upper edge that is connected to the lid 4 at a boundary between the side wall 26 and the upper wall 28 through a top hinge 36, and is provided in a lower end thereof with a folded flap 38.

The folded flap 38 is formed by folding back the lower end of the band-like member 34 along a fold-back line 38*a* in an outward-upward direction as viewed in a width direction of the box body 6. By being folded back this way, the folded flap 38 is kept in the folded-back position. That is to say, when the inner case 7 is fitted into the outer slider 8, a tip end of the folded flap 38 of the band-like member 34 is pushed against an inner face of the outer slider 8.

The band-like member 34 is provided with a middle hinge 37 between the top hinge 36 and the fold-back line 38*a*. The middle hinge 37 is formed at a position below the lid hinge 24 when the band-like member 34 is laid onto a side surface of the inner case 7. The band-like member 34 is further divided into an upper area 34*a* located between the lid hinge 24 and the middle hinge 37, and a lower area 34*b* located between the middle hinge 37 and the fold-back line 38*a*. The upper area 34*a* and the lower area 34*b* can be relatively bent along the middle hinge 37.

When the lid 4 is in a closed position, the upper wall 28 of the lid 4 has a projecting portion 39 in an opposite end to the top hinge 36. The projecting portion 39 is slightly projecting from the open end 22 in an outward direction as viewed in a width direction of the inner case 7. The projecting portion 39 functions as a stopper that regulates the sliding of the outer slider 8 when the outer slider 8 surrounding the inner case 7 slides in an upward direction.

The outer slider 8 has a hollow rectangular shape, and includes a front wall 40, a rear wall 42, and a pair of side walls 44 and 46 as illustrated in FIG. 5.

A contact flap 48 is provided to the upper edge of the first side wall 44. The contact flap 48 extends from an upper edge 50 of the first side wall 44 towards the inside of the outer slider 8 as is obvious from FIG. 5. More specifically, the contact flap 48 is folded along the upper edge 50 to be kept in such a folded-back position as to extend in an inward-downward direction as viewed in a width direction of the outer slider 8. When the inner case 7 is fitted into the outer slider 8, a tip end of the contact flap 48 is pushed against the corresponding side wall 12 of the inner case 7. Accordingly, when the outer slider 8 is slid downwards in relation to the inner case 7, the contact flap 48 is engaged with the folded flap 36 of the band-like member 34. As described above, in the present embodiment, there is formed an engaging device that engages the inner case 7 and the outer slider 8 with each other by using the band-like member 34 and the contact flap 48.

The package 2 can be fabricated with a main blank 52 forming the inner case 7 and a sub-blank 54 forming the outer slider 8.

Figure 6:
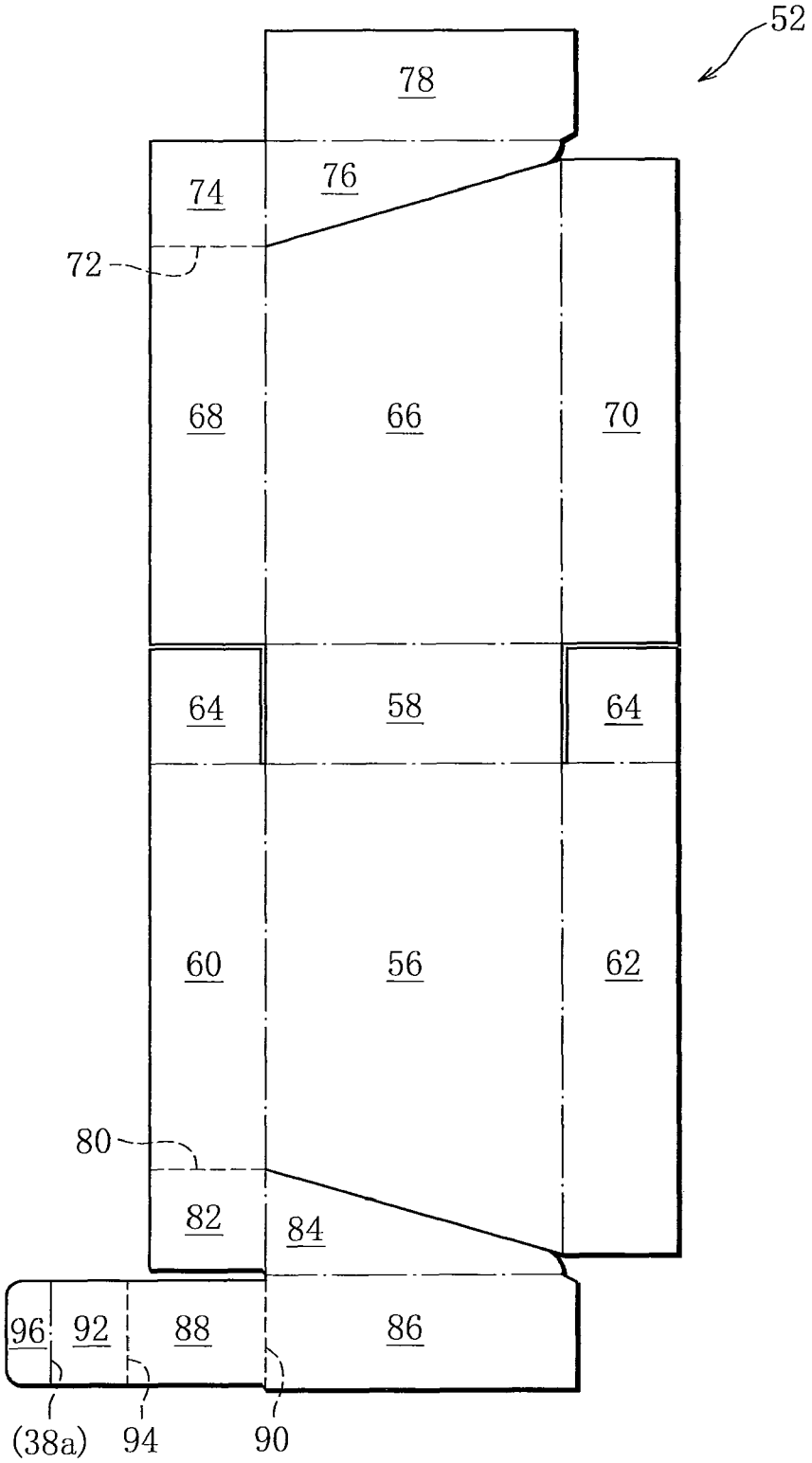
FIG. 6 is a view showing a main blank to be formed into an inner case.

As illustrated in FIG. 6, the main blank 52 has a front panel 56 serving as the front wall 16 of the box body 6. A bottom panel 58 serving as the bottom wall 20 of the box body 6 continues to an upper end of the front panel 56. An inner side flap 60 serving as a part of the side wall 12 of the box body 6 continues to a first side edge (for example, left side in FIG. 6) of the front panel 56. An inner side flap 62 serving as a part of the side wall 14 of the box body 6 continues to a second side edge (for example, right side in FIG. 6) of the front panel 56. Connected to upper ends of the inner side flaps 60 and 62 are inner bottom flaps 64. The inner bottom flaps 64 are superimposed upon the bottom panel 58 to reinforce the bottom wall 20.

A rear panel 66 serving as the rear wall 18 of the box body 6 is connected to the bottom panel 58 to be placed opposite to the front panel 56. An outer side flap 68 serving as a remaining part of the side wall 12 of the box body 6 continues to a first side edge (for example, left side in FIG. 6) of the rear panel 66. An outer side flap 70 serving as a remaining part of the side wall 14 of the box body 6 continues to a second side edge (for example, right side in FIG. 6) of the rear panel 66.

An outer side flap 74 serving as a part of the side wall 26 of the lid 4 is connected to an upper end of the outer side flap 68 through a hinge line 72 serving as a part of the lid hinge 24. Connected to a side edge (for example, right side in FIG. 6) of the outer side flap 74 is a rear panel 76 serving as the rear wall 32 of the lid 4. A top panel 78 serving as a part of the upper wall 28 of the lid 4 continues to an upper end of the rear panel 76.

An inner side flap 82 serving as a remaining part of the side wall 26 of the lid 4 is connected to a lower end of the inner side flap 60 through a hinge line 80 serving as a remaining part of the lid hinge 24. Connected to a side edge (for example, right side in FIG. 6) of the inner side flap 82 is a front panel 84 serving as the front wall 30 of the lid 4. An inner top flap 86 serving as a remaining part of the upper wall 28 of the lid 4 is connected to a lower end of the front panel 84.

An upper flap 88 serving as the upper area 34*a* of the band-like member 34 continues to a side edge (for example, left side in FIG. 6) of the inner top flap 86 through a hinge line 90 serving as the top hinge 36. A lower flap 92 serving as the lower area 34*b* of the band-like member 34 continues to the upper flap 88 through a hinge line 94 serving as the middle hinge 37 so as to be located opposite to the inner top flap 86. The folded flap 38 of the band-like member 34, or a folded flap 96, is connected to the lower flap 92 to be located opposite to the upper flap 88.

Figure 7:
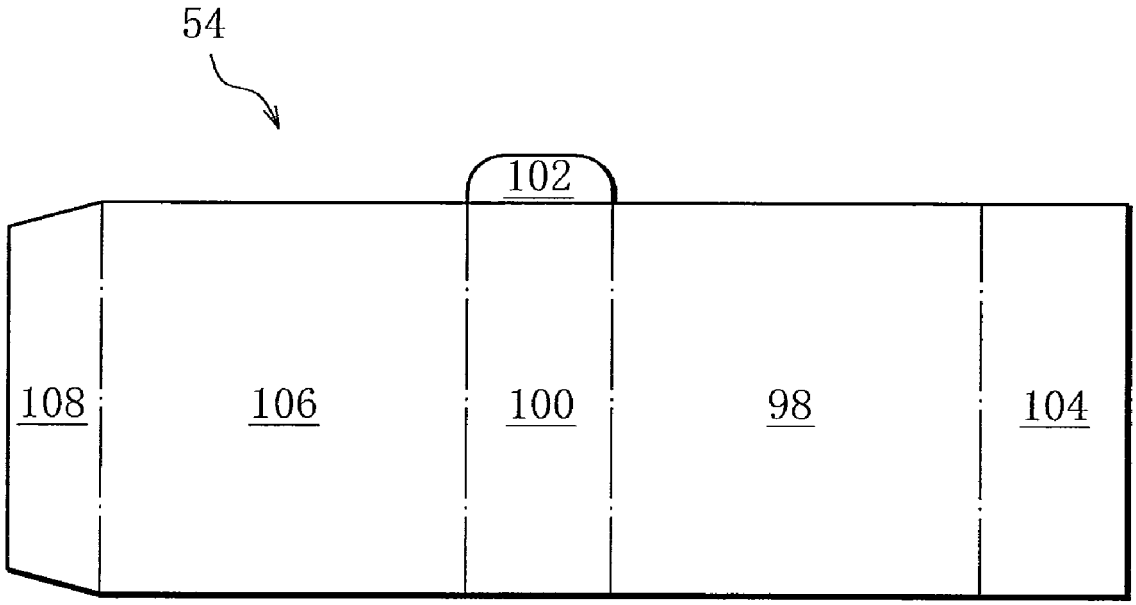
FIG. 7 is a view showing a sub-blank to be formed into the outer slider.

As illustrated in FIG. 7, the sub-blank 54 includes a rear panel 98 serving as the rear wall 42 of the outer slider 8. Connected to a first side edge (for example, left side in FIG. 7) of the rear panel 98 is a side panel 100 serving as the side wall 44 of the outer slider 8. The contact flap 48 of the outer slider 8, or a contact flap 102, is connected to an upper end of the side panel 100. A side panel 104 serving as a part of the side wall 46 of the outer slider 8 is connected to a second side edge (for example, right side in FIG. 7) of the rear panel 98. A front panel 106 serving as the front wall 40 of the outer slider 8 and an inner side flap 108 serving as a remaining part of the side wall 46 of the outer slider 8 are connected to the side panel 100 in this order so as to be located opposite to the rear panel 98.

In the present embodiment, the blanks 52 and 54 are made of paper, and have a basic weight ranging from 180 to 270 $g/m^2$ and a thickness ranging from 0.2 to 0.5 mm. The blanks 52 and 54 may be made of any one of card board, manila board, etc.

The blanks 52 and 54 are folded along fold lines shown by dashed lines in FIGS. 6 and 7 to form the inner case 7 and the outer slider 8, respectively. This folding produces the package 2 with the lid 4 closed as illustrated in FIG. 1.

More specifically, the folding of the package 2 is started with the folding of the main blank 52. The inner pack 10 is placed on the front panels 56 and 84. In this position, the inner side flaps 60, 82 and 62, the inner bottom flap 64 and the bottom panel 58 are folded towards the inner pack 10. Subsequently, the rear panels 66 and 76, and the outer side flaps 68, 74 and 70 are folded over the inner pack 10. The outer side flaps are bonded to the respective inner side flaps. The inner pack 10 is bonded to the front panel 56, the rear panel 66, the bottom panel 58, the inner side flaps 60 and 62, etc., as needed. In the next step, the folding of the inner top flap 86 and the top panel 78 is carried out. The inner top flap 86 is bonded to an inner face of the top panel 78. The upper flap 88, the lower flap 92 and the folded flap 96 are folded in a prescribed manner or folded to be kept in a folded-back position along the hinge lines 90 and 94 and a fold line (fold-back line 38*a*). In this manner, an intermediate product including the inner pack 10 is obtained.

In the sub-blank 54, firstly, the contact flap 102 is folded towards an inner face of the sub-blank 54, which is a direction towards the inside of the outer slider 8. The intermediate product is placed on the front panel 106 of the sub-blank 54 so that the top and bottom of the intermediate product and those of the sub-blank 54 are aligned correctly. The front panel 106 is superimposed upon the front panels 56 and 84 of the intermediate product. In this position, the sub-blank 54 is folded around and bonded to the intermediate product as publicly known. As a result, the package 2 shown in FIG. 1, in which the outer slider 8 is fitted to the inner case 7, is formed.

The hinge-lid package 2 is then wrapped, for example, with transparent film.

A consumer who bought the package 2 first opens the outer wrapping film and slides down the outer slider 8 in relation to the inner case 7. The customer thus opens the lid 4 and exposes the upper portion of the inner pack 10 contained in the box body 6.

Figure 8:
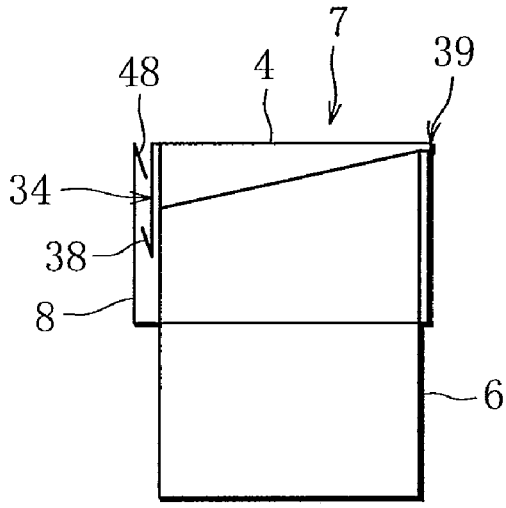
FIG. 8 is a schematic view showing a state in which a lid of the inner case is closed.

The opening action of the package 2, or of the lid 4, will be described below in detail with reference to FIGS. 8 to 11. At first, as illustrated in FIG. 8, the outer slider 8 is positioned in the upper part of the inner case 7, and the lid 4 is in a closed position. At this point, the projecting portion 39 of the lid 4 is in contact with an upper edge of the outer slider 8. The projecting portion 39 thus blocks the upper slider 8 from further moving upwards. The outer slider 8 is accordingly prevented from slipping out of the inner case 7.

Figure 9:
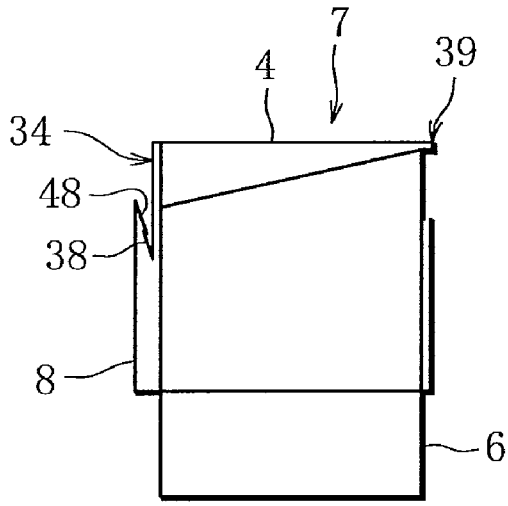
FIG. 9 is a schematic view showing a state in which the outer slider is sliding downwards.

In this position, when the outer slider 8 is shifted downwards in relation to the inner case 7, the contact flap 48 of the outer slider 8 contacts the folded flap 38 of the band-like member 34 (FIG. 9). When the outer slider 8 is further shifted downwards, the folded flap 38 and the contact flap 48 are engaged with each other. As a result, a side portion of the lid 4 is pulled relatively downwards by the band-like member 34. This pulling turns the lid 4 about the lid hinge 24 and opens the lid 4. Consequently, the lid 4 starts to open. Accordingly, the upper portion of the inner pack 10 is gradually exposed from the box body 6.

Figure 10:
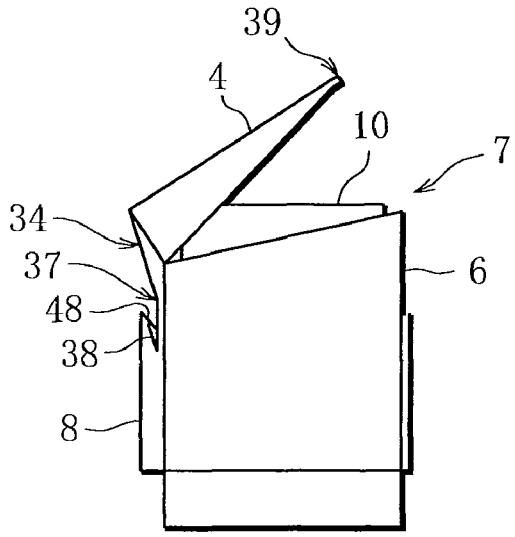
FIG. 10 is a schematic view showing a state in which the lid of the inner case just begins to open.
Figure 11:
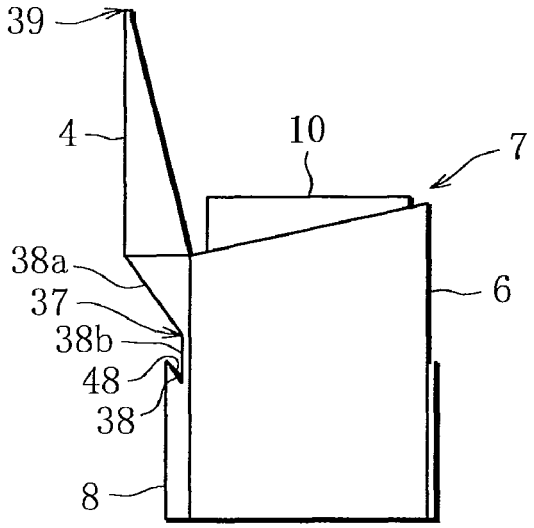
FIG. 11 is a schematic view showing a state in which the lid of the inner case is entirely open.

When the outer slider 8 is shifted downwards, and the middle hinge 37 of the band-like member 34 is exposed outside of the outer slider 8, the upper area 34*a* of the band-like member 34 is bent at the middle hinge 37 outwards in relation to the lower area 34*b*. This makes the lid 4 open smoothly (FIG. 10). When the outer slider 8 is further shifted downwards, the lid 4 opens 90 degrees from the closed position thereof, thoroughly exposing the upper portion of the inner pack 10 (FIG. 11).

As is apparent from the foregoing description, when the lid 4 is in the closed position, an upper end of the outer slider 8 virtually meets the upper wall 28 of the lid 4. When the outer slider 8 is shifted downwards, and a lower end of the outer slider 8 meets the bottom wall 20 of the box body 6, the lid 4 is turned 90 degrees from the closed position thereof and is brought into the open position.

When the lower end of the outer slider 8 meets a lower end of the box body 6, the upper portion of the inner pack 10 is thoroughly exposed. Usually, the outer slider 8 is not further pulled down. However, if the consumer further pulls down the outer slider 8, the lid 4 reaches a limit of the opening action when turned close to 180 degrees. For that reason, the outer slider 8 is not further shifted downwards in relation to the inner case 7. In other words, the engagement between the contact flap 48 and the folded flap 36 not only opens the lid 4 but also regulates a downward slide amount of the outer slider 8 and prevents the outer slider 8 from slipping out of the inner case 7.

To be more concrete, in the case of the present embodiment, a positional relationship between the contact flap 48 and the folded flap 38 and the length of the band-like member 34 are determined so that the lid 4 is turned 90 degrees to open when the lower end of the outer slider 8 and that of the box body 6 meet each other, and that even if the outer slider 8 is further pulled down, the sliding of the outer slider 8 is prevented by the limit of the opening action of the lid 4 before the outer slider 8 slips out of the box body 6.

The contact flap 48 and the folded flap 38 are both sandwiched between the outer slider 8 and the inner case 7, and are constantly in contact with the outer slider 8 or the inner case 7. This creates resistance against the sliding of the outer slider 8, and suppresses the outer slider 8 from sliding undesirably.

When the inner pack 10 is exposed from the open end 22 of the box body 6, the consumer opens the inner pack 10 and retrieves the tobacco products from the inner pack 10. On the contrary, when the inner pack 10 is to be contained, the consumer moves the outer slider 8 upwards in relation to the box body 6, and thus disengages the contact flap 48 and the folded flap 38 from each other. The lid 4 is gradually closed while being guided by the inner wall of the outer slider 8. Finally, at the point when the upper end of the outer slider 8, namely, an upper end of the side wall 46, contacts the projecting portion 39 of the lid 4, the lid 4 is in a completely closed position. In this manner, the consumer can close the package 2.

When retrieving the tobacco products next time, the consumer has only to move the outer slider 8 downwards in the above-described manner.

Since the package 2 of the present embodiment has the lid 4 that opens in conjunction with the pulling-down action of the outer slider 8 as mentioned above, the opening/closing pattern of the package 2 is novel as compared to conventional packages. The package 2 therefore arouses consumers' interest. Since the package 2 includes the projecting portion 39 and the band-like member 34 which are provided to the lid 4, the outer slider 8 is effectively prevented from slipping out of the inner case 7. The present embodiment makes it possible to easily produce a configuration for regulating the slide amount of the outer slider 8.

The package 2 of the present embodiment can suppress deterioration in freshness of tobacco products contained in the inner pack 10 by being closed with the lid 4, and moreover, is usable for the inner pack 10 to be packed as a refill.

The invention is not limited to the above-described one embodiment, but may be modified in various ways. For example, the open end 22 of the box body 6 may extend from the lid hinge 24 in an obliquely downward direction. Basically, as long as the upper portion of the inner pack is widely exposed from the box body 6, the open end may be inclined in either direction. The lid 4 may have a projecting portion similar to the projecting portion 39 between the upper wall 28 and the front wall 30 or between the upper wall 28 and the rear wall 32. That is to say, the lid 4 has only to include at least one projecting portion for regulating the sliding of the outer slider 8. The inner pack 10 may be formed by packing tobacco products with a length of about 85 mm. Products that can be contained do not necessarily have to be tobacco products, and may be other products such as foods including snacks and the like. The hinge-lid package of the invention may be employed as a package for these products.

REFERENCE MARKS

2 package
4 lid
6 box body
7 inner case
8 outer slider
10 inner pack
12, 14 side wall
16 front wall

18 rear wall
20 bottom wall
22 open end
24 lid hinge
26 side wall
28 upper wall
30 front wall
32 rear wall
34 band-like member
36 top hinge
37 middle hinge
38 folded flap
39 projecting portion
40 front wall
42 rear wall
44, 46 side wall
48 contact flap
50 upper edge
52 main blank
54 sub-blank

The invention claimed is:

1. A slide-action hinge-lid package comprising:

an inner case being formed in a rectangular parallelepiped shape and having a box body with an open end in an upper portion thereof and a box-shaped lid that is connected to a first side edge that is a short side of the open end and turns about a lid hinge to open/close the open end;

an outer slider that is slidably fitted around an outer periphery of the inner case; and an engaging device that allows engagement between the inner case and the outer slider when the outer slider is slid relative to the inner case, and imparts an opening/closing action to the lid in conjunction with the sliding of the outer slider, wherein a length of the outer slider, in a sliding direction thereof, is shorter than a length of the box body in the sliding direction, and when an upper end of the outer slider is located closer to a bottom wall of the box body than that of the lid hinge, and also a lower end of the outer slider is flush with the bottom wall of the box body, the lid is fully open.

2. The slide-action hinge-lid package according to claim 1, wherein the engaging device includes:

a band-like member provided on an outer face of the lid, the band-like member extending along a side wall of the lid, which is located on the first-side-edge side, having an upper end connected to an upper part of the lid hinge through a top hinge parallel to the lid hinge, and having a lower end provided with a folded flap that is folded back towards an inner face of the outer slider; and a contact flap being provided to the inner face of the outer slider and extending towards the folded flap, wherein:

when the outer slider is slid towards the folded flap, the contact flap is engaged with the folded flap.

3. The slide-action hinge-lid package according to claim 2, wherein:

the top hinge is located in an upper edge of the side wall of the lid;

the band-like member further has a middle hinge that is parallel to the top hinge and located between the top hinge and the folded flap;

the middle hinge is located below the lid hinge when the band-like member is superimposed on the side wall of the lid; and an upper edge of the outer slider is located under the middle hinge in order to expose the middle hinge from the outer slider at the same time or before the outer slider is slid to engage the contact flap with the folded flap.

4. The slide-action hinge-lid package according to claim 3, wherein the inner case further includes a projecting portion projecting from the outer periphery of the inner case, the projecting portion being formed on a peripheral edge of an upper wall of the lid.

5. The slide-action hinge-lid package according to claim 4, wherein upper edges of front and rear walls of the box body, which are a pair of long sides of the open end, are inclined in an upward or downward direction from the lid hinge.

* * * * *